US005363071A

United States Patent [19]

Schwent et al.

[11] Patent Number: 5,363,071

[45] Date of Patent: Nov. 8, 1994

[54] APPARATUS AND METHOD FOR VARYING THE COUPLING OF A RADIO FREQUENCY SIGNAL

[75] Inventors: Dale G. Schwent, Hoffman Estates; Rashid M. Osmani, Carol Stream, both of Ill.

[73] Assignee: Motorola, Inc., Schaumburg, Ill.

[21] Appl. No.: 55,900

[22] Filed: May 4, 1993

[51] Int. Cl.[5] ..... H01P 5/18

[52] U.S. Cl. ..... 333/111; 333/116; 333/17.1

[58] Field of Search ..... 333/109, 111, 113, 115, 333/116, 17.1; 330/129, 279; 455/116, 126, 127

[56] References Cited

U.S. PATENT DOCUMENTS

| | | | |
|---|---|---|---|
| 4,571,545 | 2/1986 | Griffin et al. | 333/109 |
| 5,006,821 | 4/1991 | Tam et al. | 333/116 |
| 5,126,686 | 6/1992 | Tam | 330/279 X |

*Primary Examiner*—Paul Gensler
*Attorney, Agent, or Firm*—Kevin D. Kasche

[57] ABSTRACT

An apparatus and method for varying coupling of a radio frequency (RF) signal (408). This is advantageously used for increasing the dynamic range of a power detector (406) in an automatic power level control loop (403) of a transmission unit (404), while maintaining transmission unit efficiency at higher power levels. This is accomplished by selecting between a first operating mode of the RF coupler (405) having strong coupling, responsive to a first predetermined power level, such that the RF coupler (405) produces a first coupled RF signal (509) responsive to the RF signal (408) and a second operating mode of the RF coupler (405) having weak coupling, responsive to a second predetermined power level, such that the RF coupler (405) produces a second coupled RF signal (510) responsive to the RF signal (408).

5 Claims, 3 Drawing Sheets

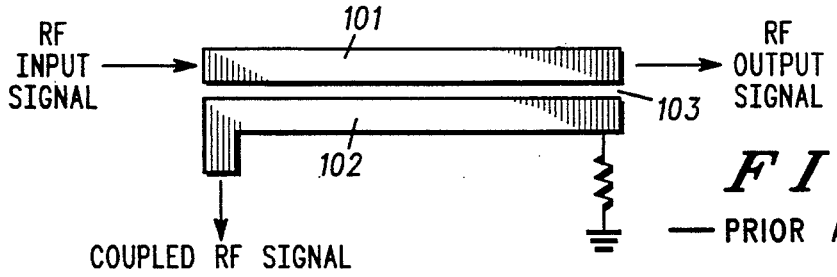
FIG. 1
— PRIOR ART —
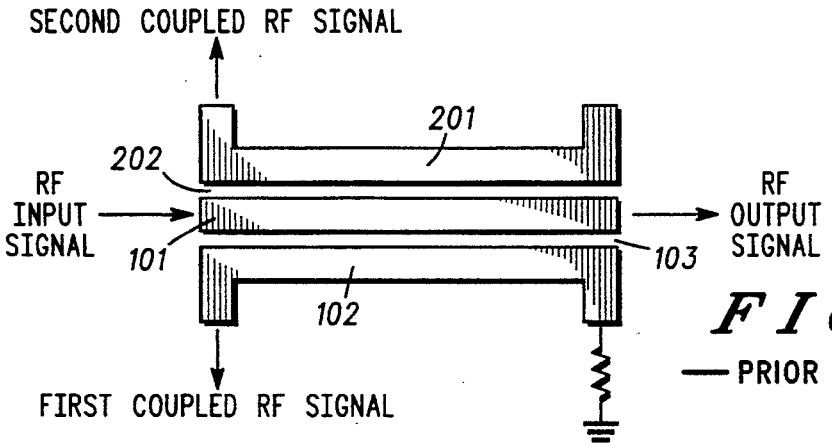
FIG. 2
— PRIOR ART —
FIG. 3
— PRIOR ART —
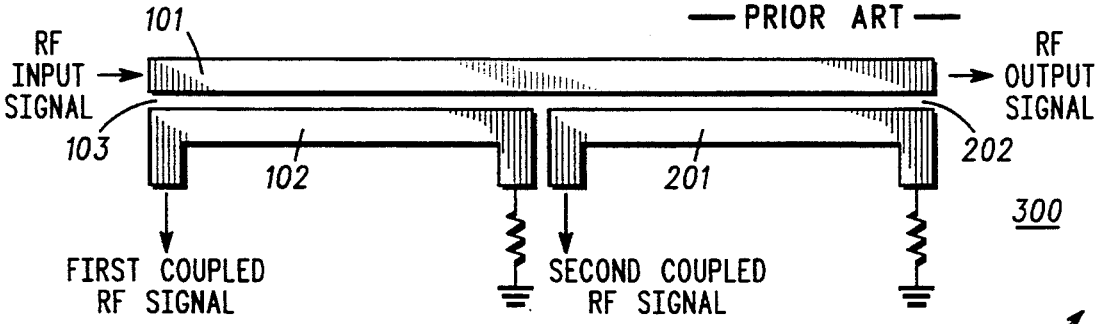
FIG. 4
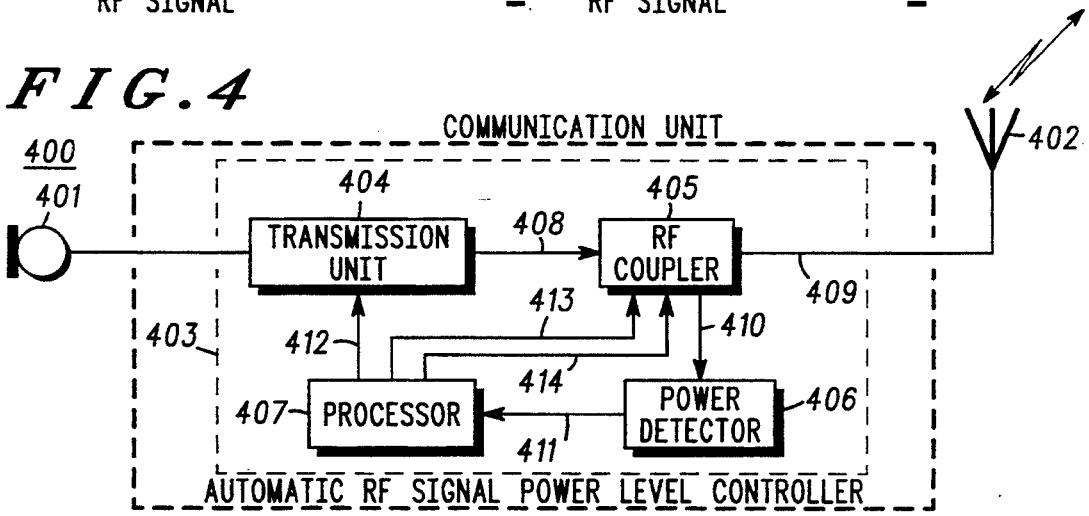

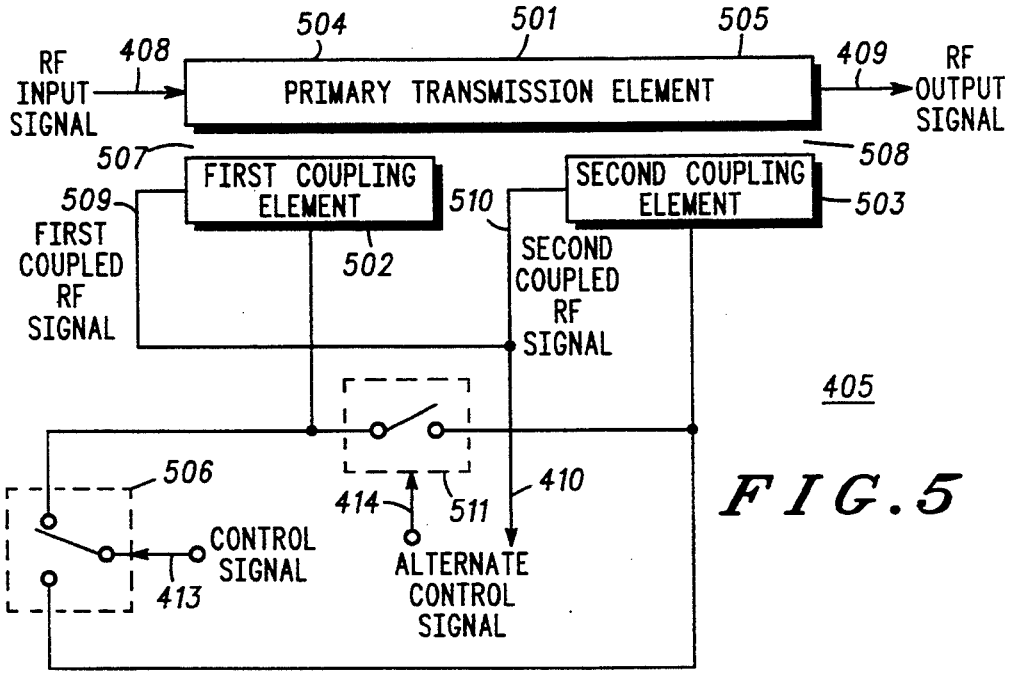
FIG. 5
FIG. 6
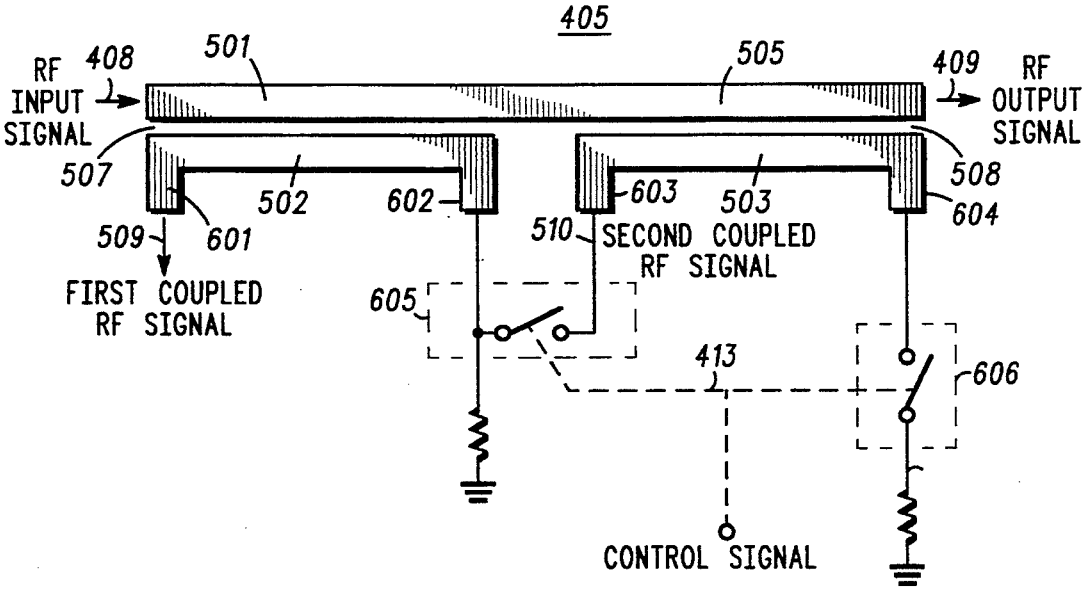

APPARATUS AND METHOD FOR VARYING THE COUPLING OF A RADIO FREQUENCY SIGNAL

FIELD OF THE INVENTION

The present invention relates generally to radio frequency couplers and more particularly to an apparatus and method for varying the coupling of a radio frequency (RF) signal.

BACKGROUND OF THE INVENTION

The basic operation and structure of communication systems, such as cellular radio telephone systems communication systems and land mobile communication systems, are well known in the art. Communication systems typically comprise a plurality of communication units, a predetermined number of base station (or repeaters) located throughout a geographic region and a controller. The communication units may be vehicle mounted or portable units and comprise either a transmitter or a receiver or both to form a transceiver. The communication unit is coupled to the base station by a communication channel over which radio frequency (RF) signals are transmitted and/or received. The controller comprises a centralized call processing unit or a network of distributed controllers working together to establish communication paths for the communication units.

It is well known in the art for transmitters to include an automatic signal power level control loop to maintain the output power level of a transmitted RF signal at one of a plurality of predetermined power levels. Automatic signal power level control loops generally typically comprise an RF coupler, a power level detector and a processor. The RF coupler couples a portion of the transmitted RF signal to the power level detector. The power level detector detects the power level of the transmitted RF signal to produce an output signal. The processor adjusts the power level of the transmitted RF signal responsive to the output signal to maintain the output power level of the transmitted RF signal at one of the plurality of predetermined power levels.

FIG. 1 illustrates a schematic diagram of a first prior art RF coupler 100. The RF coupler 100 generally comprises a primary transmission element 101 and a first secondary coupling element 102. The primary transmission element 101 receives at its input an RF input and produces an RF output at its output. The first secondary coupling element 102 couples a portion of the RF signal to produce a coupled RF output signal. The physical dimensions of the primary transmission element and the first secondary coupling element and the distance 103 from the primary transmission element determine the amount of the RF signal coupled.

FIG. 2 illustrates a schematic diagram of a second prior art RF coupler 200 including the primary transmission element 101 and the first secondary coupling element 102 as of FIG. 1. The first secondary coupling element 102 couples at least a portion of the RF signal to produce a first coupled RF output signal. A second secondary coupling element 201 couples at least a portion of the RF signal to produce a second coupled RF output signal. The first and second coupled RF signals may be adjusted by varying the dimensions of the secondary coupling elements 102 and 201 and by varying the spacing 103 and 202, respectively, between each secondary coupling element 102 and 201 and the primary transmission element 101. However, a disadvantage of this structure is cross coupling between the first and the second secondary coupling elements 102 and 201.

FIG. 3 illustrates a schematic diagram of a third prior art RF coupler 300 overcoming the disadvantage of the RF coupler of FIG. 2. Instead of placing the second secondary coupling element 201 opposite to the first secondary coupling element 102, the second secondary coupling element 201 is offset from the first secondary coupling element 102 to substantially reduce the cross coupling between the secondary coupling elements 102 and 201.

The range of coupled transmitted RF signal power levels at the power detector's input for which the power detector's output signal is usable is commonly referred to as the power detector's dynamic range. Some communication systems now require the transmitters to operate over a wider range of signal power levels to communicate with the base stations. This requirement can be met by increasing the dynamic range of the power detector.

The dynamic range of the power detector is related to the power level of the coupled transmitted RF signal. At high transmitter power levels, RF couplers couple a large mount of signal power level for detect/on by the power detector. However, a significant portion of the coupled transmitted RF signal is lost at high power levels. Therefore, the current drain of the transmitter is increased to overcome the loss of power at high power levels which reduces the transmitter's efficiency. At low transmitter power levels, RF couplers provide a low amount of signal power level for detection by the power detector. However, at the low transmitter power levels there may not be enough signal power available at the power detector's input to generate a usable output signal.

Therefore, there is a need for an RF coupler providing variable RF coupling of the transmitted RF signal to increase the dynamic range of the power detector in the transmitter such that the transmitter can operate over a wider range of predetermined power levels.

BRIEF DESCRIPTION OF THE DRAWINGS

FIG. 1 illustrates a schematic diagram of a first prior art radio frequency (RF) coupler.

FIG. 2 illustrates a schematic diagram of a second prior art RF coupler.

FIG. 3 illustrates a schematic diagram of a third prior art RF coupler.

FIG. 4 illustrates a block diagram of a communication unit in accordance with the present invention.

FIG. 5 illustrates a block diagram of the RF coupler of FIG. 4 in accordance with the present invention.

FIG. 6 illustrates a schematic diagram of the RF coupler of FIG. 5 including RF switches in accordance with the present invention.

DETAILED DESCRIPTION OF THE PREFERRED EMBODIMENTS

Figure 7:
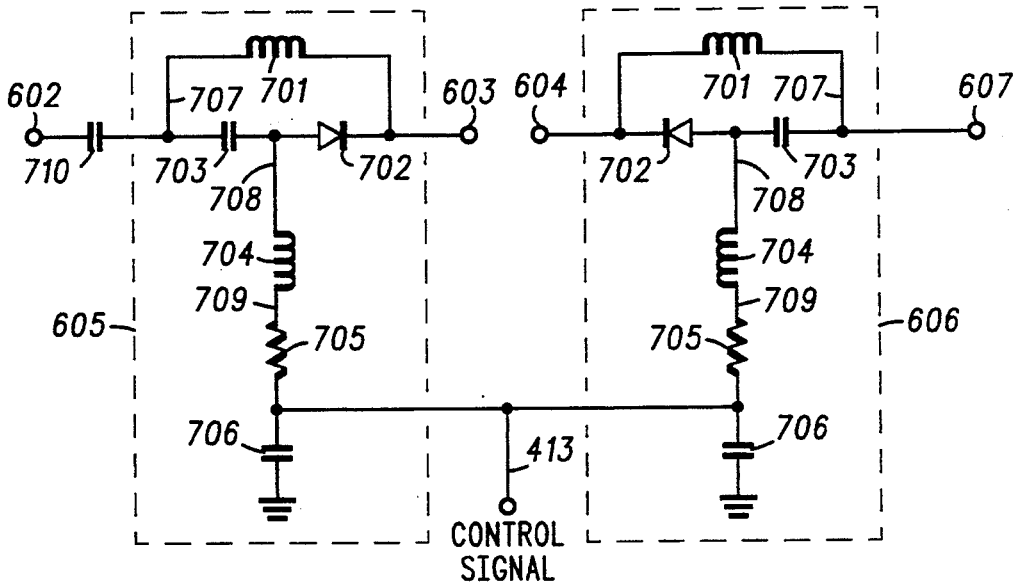
FIG. 7 illustrates a schematic diagram of the RF switches of FIG. 6 in accordance with the present invention.

Generally, the present invention provides an apparatus and method for varying coupling of a radio frequency (RF) signal. This is advantageously used for increasing the dynamic range of a power detector in an automatic power level control loop of a transmission unit, while maintaining transmission unit efficiency at higher power levels. This is accomplished by selecting between a first operating mode of the RF coupler having strong coupling, responsive to a first predetermined power level, such that the RF coupler produces a first coupled RF signal responsive to the RF signal and a second operating mode of the RF coupler having weak coupling, responsive to a second predetermined power level, such that the RF coupler produces a second coupled RF signal responsive to the RF signal.

The present invention can be more fully described with reference to FIGS. 4–8. FIG. 4 illustrates a block diagram of a communication unit 400 constructed in accordance with the present invention. The communication unit 400 generally comprises a microphone 401, an automatic RF signal power level controller 403, and an antenna 402. Communication units are generally well known in the art, thus no further discussion will be presented except to facilitate the understanding to the present invention. Examples of a communication unit include portable or mobile cellular subscriber unit, for example a radio telephone available from Motorola having model number SUF1700B, as well as a base station or repeater.

The automatic RF signal power level controller generally comprises a transmission unit 404 operative to produce an RF signal at line 408 at a plurality of predetermined power levels, an RF coupler 405, a power detector 406, and a processor 407. The RF coupler 405 is operably coupled to the output of transmission unit 404 by line 408, and to antenna 402 by line 409. The coupled RF signal, is output to power detector 406 on line 410, and is a reduced power level version of the input signal on line 408. The relationship between the power levels on lines 408 and 410 is the coupling factor of RF coupler 405. In accordance with the present invention, different operating modes having different coupling factors are selected in response to a control signal on line 413 and an alternate control signal on line 414.

Transmission unit 404 generally includes elements well known in the art such as speech processors, a modulator, synthesizers, and RF amplifier stages. One or more RF amplifier stages will have gain responsive to a correction signal on line 412.

Power detector 406 receives the coupled RF signal on line 410 and converts it into a detected signal on line 411. The DC value of the detected signal is responsive to the power level of the coupled RF signal on line 410 over the dynamic range of the detector, and therefore, to the power level of the signal on line 408. Line 408 power is further related to the output power level on line 409 by the insertion loss of RF coupler 405, so the detected signal on line 411 is effectively responsive to changes in output power level on line 409.

Processor 407 receives the detected signal on line 411 and compares it to a target value corresponding to the predetermined output power on line 409. This comparison is used to generate a correction signal on line 412 adjusting the gain of the transmission unit to maintain the output power at line 409 at the predetermined level. Processor 407 also generates a control signal on line 413 and an alternate control signal on line 414 responsive to the predetermined power level, alternately selecting between the first and second operating modes of the coupler. Processor 407 may be a microprocessor such as a Motorola MC68HC11F1 or a digital signal processor such as Motorola DSP56156FE-60, and may incorporate other circuitry such as op-amps, A/D, and D/A convertors to process the detected and correction signals.

FIG. 5 illustrates a block diagram of the RF coupler 405 of FIG. 4 constructed in accordance with the present invention. The RF coupler 405 generally comprises a primary transmission element 501, a first coupling element 502, a second coupling element 503, and switches 506 and 511. The primary transmission element 501 has an input end 504 for receiving the RF input signal 408, and an output end 505 for transmitting the RF signal 409. The first coupling element 502 produces the first coupled RF signal 509, a reduced power version of RF input signal 408. When the first coupling element 502 is enabled, the power of 509 is related to the power of RF input signal 408 by a first coupling constant. The first coupled RF signal 509 is coupled to line 410, the coupled RF signal output. The second coupling element 503 produces the second coupled RF signal 510, a reduced power version of RF input signal 408. When the second coupling element 503 is enabled, the power of 510 is related to the power of RF input signal 408 by a second coupling constant. The second coupled RF signal 510 is also coupled to line 410, the coupled RF signal output.

Each coupling element is responsive to control signal 413 and alternate control signal 414. When the control signal 413 enables the first coupling element 502, the first coupled RF signal 509 appears at line 410. If at the same time, the alternate control signal places switch 511 in an open state, this leaves the second coupling element 503 not enabled, so that it produces no output at 510, and has no effect on the signal at 410, or on the signal in the primary transmission element 501. When the control signal 413 enables the second coupling dement 503, the second coupled RF signal 510 appears at line 410. If at the same time, the alternate control signal places switch 511 in an open state, this leaves the first coupling element 502 not enabled, so that it produces no output at 509, and has no effect on the signal at 410, or on the signal in the primary transmission element 501. When the alternate control signal 414 places switch 511 in a closed state, both coupling elements 502 and 503 will be enabled, and both will contribute to the total power appearing at line 410.

The primary transmission element 501 and first and second coupling elements 502 and 503 can be formed from transmission lines in close proximity such as stripline or microstrip, or from any other transmission means allowing directive coupling, for example, aperture coupled waveguides. First and second coupling constants are selected as desired by changing the physical construction of the primary and coupling elements 501, 502, and 503. For the case of stripline or microstrip couplers, varying the distance between transmission lines, the length over which the lines are in close proximity, or the dielectric constant of the substrate will produce the selected coupling constants.

According to the teachings of the present invention, the first coupling element 502 may be designed with relatively weak coupling. The coupling constant of this first coupling element 502 is chosen just large enough to provide enough coupled RF signal at line 410 for proper operation of the power detector 406 at the higher of the plurality of power levels at which the transmission unit 404 operates. This element couples off only a small amount of power from the primary transmission element 501, so that the power of RF input signal 408 is reduced only a small amount. This is desirable so as not to impact the efficiency of the transmission unit.

The second coupling dement 503 may be designed with relatively strong coupling. The coupling constant of this second coupling element 503 is chosen large enough to ensure that enough coupled RF signal appears at line 410 for proper operation of the power detector 406 even at the lowest of the plurality of power levels at which the transmission unit 404 operates. Even if this element couples off a large amount of power from the primary transmission element 501, at the lower power levels transmission unit efficiency is typically not substantially degraded. This is because the current drain of the transmission unit is not strongly related to transmission unit power output level at the lowest power levels.

The control signal 413 selects which of the two couplers is enabled, and providing a coupled RF signal to line 410. The alternate control signal 414 allows both couplers to be enabled by tying both coupler enable lines together. In any case, a disabled coupler does not couple off any substantial power from the primary transmission element 501. This is necessary to prevent the strong coupler from degrading transmission unit efficiency at the higher power output levels, when current drain is a strong function of power output level. At lower output power levels the weak coupler may be left enabled since its contribution to total power at line 410 will be small, or not enabled if other performance parameters are improved by doing so. The control signal 413 and alternate control signal 414 are generated by processor 407 in response to a predetermined desired power level from the power detector 406 or from an external source such as the base station of a cellular telephone system.

FIG. 6 illustrates the RF coupler 405 of FIG. 5 constructed with transmission lines. The RF coupler 405 generally includes a primary RF transmission element 50 1, the first coupling element 502, and the second coupling element 503. The primary RF transmission element 501 has an input end for receiving the RF input signal 408, and an output end for transmitting the RF output signal 409. The first coupling element 502 is weakly coupled to the primary transmission element 501, coupling a minimal amount of power to produce the first coupled RF signal 509 at its first end 601, with its second end 602 coupled to ground through a terminating resistor. The second coupling element 503 is strongly coupled to the primary transmission element 50 1, coupling a large amount of power to produce the second coupled RF signal 510 at its first end 603, with its second end 604 coupled to ground through a switch 606 and a terminating resistor.

According to the teachings of the present invention, switches 605 and 606 are responsive to a control signal 413. The first RF switch 605 is coupled to the second end of the first coupling element 602 and the first end of the second coupling element 603, This switch selectively couples the second coupled RF signal 510 to the second end of the first coupling element 602. Once coupled to this element, the signal travels down the first coupling element 502 and appears at the first end of the first coupling element 601. Because the coupling in the second coupling element 503 is strong, its signal appearing at end 601 dominates that produced by the first coupling element 502, so the signal at end 601 is essentially the second coupled RF signal. Proper choice of terminating resistors and transmission line impedances allows the directivity of this structure to be maintained at an acceptable level. When RF switch 605 is in an open state, only the first coupled RF signal 509 from the weak coupler can appear at end 601. Therefore switch 605 petrols the function of selecting how much coupled signal will appear at end 601.

The second RF switch 606 is coupled to the second end of the second transmission line 604 and ground through a terminating resister. This switch selectively decouples end 604 from the terminating resistor. With both RF switches 605 and 606 in an open state all resistive elements are removed from the second coupled element 503. Therefore, any power coupled onto the second coupling element 503, will be reflected off the open circuited ends 603 and 604, and be coupled back onto the primary RF transmission element 501, resulting in minimal loss to the RF input signal 408. Proper choice of transmission line impedances will maintain the desired input impedance for the RF input signal 408 at end 501. When RF switch 606 is in a closed state it couples the required terminating resistor onto the second coupling element 503, maintaining acceptable directivity for the structure.

The control signal 413 alternately places both RF switches 605 and 606 into a closed state for the strong coupling mode, or into an open state for the weak coupling mode. The control signal 413 is generated by 407 in response to a predetermined power level from the power detector 406 or from an external source such as the base station of a cellular telephone system.

FIG. 7 illustrates a schematic diagram of the RF switches of FIG. 6. Switch 605 is selectively coupled between the second RF signal at end 603 and the second end 602 of the first coupling element 502 through DC blocking capacitor 710. Switch 606 is selectively coupled between the second end 604 of the second coupling element 503 and ground through a terminating resistor at 607. Switch 606 generally comprises inductors 701 and 704, capacitors 703 and 706, resistor 705, and PIN diode 702.

PIN diode 702 is an RF switch coupled to end 604 of the second coupling element 503 at its cathode, and to line 708 at its anode. When provided with sufficient DC bias current it appears as a low resistance with a parasitic series inductance. When DC bias is removed, it appears as a high resistance with a parasitic parallel capacitance. If parasitic elements can be ignored or compensated out, the PIN diode acts as a switch for RF in response to a DC current being applied.

Inductor 704 is coupled at a first end to the anode of PIN diode 702 through line 708 and at the second end to the first end of resistor 705 through line 709. This inductor serves as an RF choke to allow the DC bias current into the diode while presenting a high impedance at the RF frequency of operation for the switch 606, so as to isolate the bias circuitry from the RF elements. Resistor 705 is coupled at its second end to a first end of capacitor 706 and to the control signal 413. This resister sets the bias current through PIN diode 702 when it is in the on state. Capacitor 706 is a bypass capacitor coupled to ground at a second end, and provides additional isolation of bias circuitry from RF signals.

Capacitor 703 is coupled at a first end to line 708 and at a second end to a terminating resistor at 607. This capacitor is chosen to resonate out the parasitic series inductance of PIN diode 702 when it is on, to provide good low impedance connections when in the on state. Capacitor 703 also serves as a DC block. Inductor 701 is coupled at a first end to end 604 of the second coupling element 503 and at a second end to a terminating resistor at 607. This inductor is chosen to resonate out the parasitic parallel capacitance of PIN diode 702 when it is off, to provide high isolation in the off state. Inductor 701 also provides a path for DC current to flow through PIN diode 702, with that current reaching ground through the terminating resistor at 607.

Switch 605 is identical to switch 606 and therefore needs no further identification.

Figure 8:
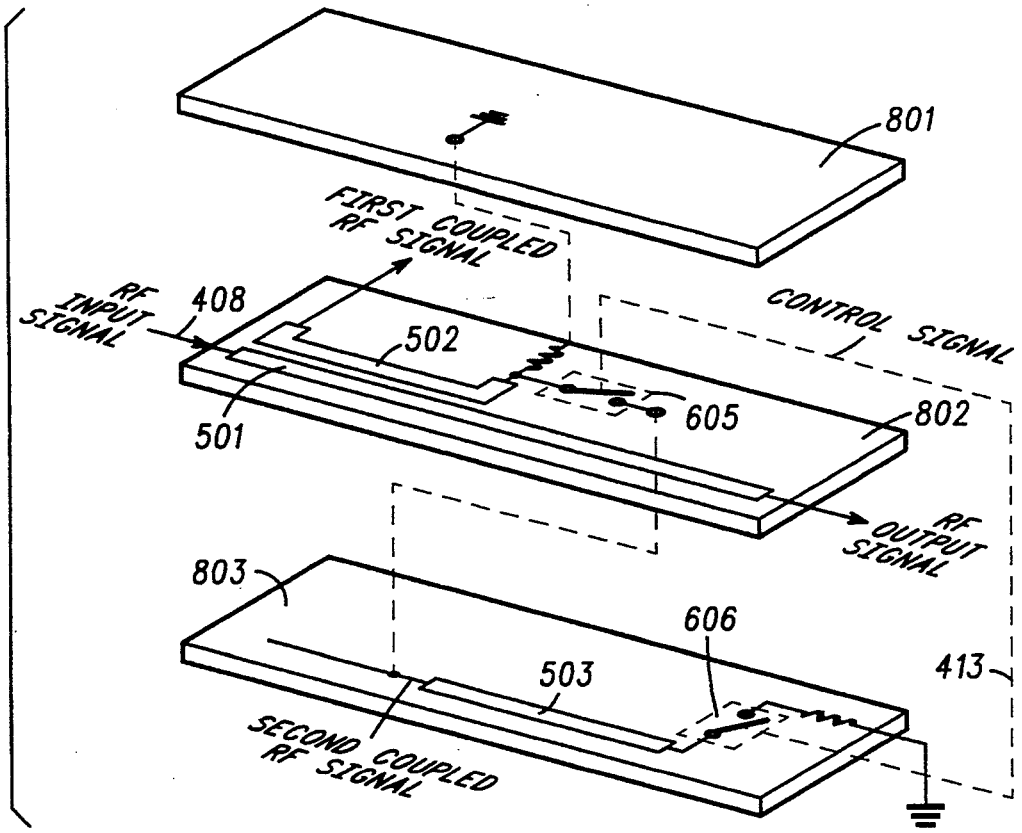
FIG. 8 illustrates a schematic diagram of the RF coupler of FIG. 6 disposed on multiple substrates in accordance with the present invention.

FIG. 8 illustrates the RF coupler 405 of FIG. 4 constructed on multiple substrates. The RF coupler 405 generally includes a primary transmission element 501, first coupling element 502, and second coupling element 503. Switches 605 and 606 select which coupling mode the RF coupler will operate in as explained with reference to FIG. 6.

The first substrate 801 is generally a dielectric material such as Teflon TM, Duroid TM, or a glass/epoxy composite such as G10. An etched or printed metallic conductor is disposed on the first side of substrate 801 forming a ground plane for the transmission line structures on substrates 802 and 803. The second side of substrate 801 is free of metallization.

The primary transmission element 501 and first coupling element 502 are generally etched or printed metallic conductors disposed on the first side of a second substrate 802. The second side of this second substrate 802 is free of metallization. First coupling element 502 is an edge coupled transmission line characterized by relatively weak coupling. The second substrate 802 is also a dielectric material as described for substrate 801.

The secondary coupling element 503 is generally an etched or printed metallic conductor disposed on the first side of a third substrate 803. Metallization is disposed on the second side of this third substrate 803 to create a stripline coupler structure. A pseudo-microstrip structure may be created by leaving this second side of substrate 803 free of metal. In either case, second coupling element 503 is a broadside coupled transmission line characterized by relatively strong coupling. The third substrate 803 is also a dielectric material as described for substrate 801.

The present invention provides a method and apparatus for varying the coupling of an RF signal. This is advantageously used for increasing the dynamic range of a power detector in an automatic power level control loop of a transmission unit, while maintaining transmission unit efficiency at higher power levels. With the present invention the problems of the prior art are substantially resolved. Prior art couplers with a single coupled output give rise to power control loops with a limited dynamic range. Prior art couplers with two coupled outputs could use both strong and weak coupling to increase dynamic farce, but they do not remove the loss of the strong coupling element at the higher power levels, resulting in increased coupler loss at high power levels. With this invention, the dynamic range may be increased without sacrificing transmission unit efficiency at the higher power levels, where efficiency is generally most important.

What is claimed is:

1. A radio frequency (RF) directional coupler for use with a transmission unit that produces an RF signal at a plurality of predetermined power levels, comprising:

a primary RF transmission element having an input end for receiving an RF signal and an output end for transmitting the RF signal;

a first directional coupling element for coupling a portion of the RF signal from the primary transmission element to produce a first coupled RF signal at a first end of the first directional coupling element, the second end of the first coupling directional element coupled to ground;

a second directional coupling element for coupling a portion of the RF signal from the primary transmission element to produce a second coupled RF signal at a first end of the second directional coupling element, the second end of the second directional coupling element coupled to ground;

a first switch, operably coupled to the first directional coupling element and the second directional coupling element, wherein the first switch selectively couples the second coupled RF signal to the second end of the first directional coupling element responsive to a first predetermined power level and selectively decouples the second coupled RF signal from the second end of the first directional coupling element responsive to a second predetermined power level; and a second switch, operably coupled to the second directional coupling element, wherein the second switch selectively couples the second end of the second directional coupling element to ground responsive to the first predetermined power level and selectively decouples the second end of the second directional coupling element from ground responsive to the second predetermined power level.

2. An RF directional coupler according to claim 1 wherein the primary transmission element, the first directional coupling element and the second directional coupling element are transmission lines each disposed on a substrate.

3. An RF directional coupler according to claim 2 wherein the primary transmission element and the first directional coupling element are disposed on a first substrate and the second directional coupling element is disposed on a second substrate.

4. An RF directional coupler according to claim 1 wherein the first and second RF coupled signals each have power levels of different magnitudes.

5. A method for controlling a radio frequency (RF) directional coupler for use with a transmission unit that produces an RF signal at a plurality of predetermined power levels, the RF directional coupler including: a primary RF transmission element having an input end for receiving an RF signal and an output end for transmitting the RF signal, a first directional coupling element for coupling a portion of the RF signal from the primary transmission element to produce a first coupled RF signal at a first end of the first directional coupling element, the second end of the first directional coupling element coupled to ground, and a second directional coupling element for coupling a portion of the RF signal from the primary transmission element to produce a second coupled RF signal at a first end of the second directional coupling element, the second end of the second directional coupling element coupled to ground, the method comprising the steps of:

selectively coupling the second coupled RF signal to the second end of the first directional coupling element, and selectively coupling the second end of the second directional coupling element to ground responsive to a first predetermined power level; and selectively decoupling the second coupled RF signal from the second end of the first directional coupling element responsive to a second predetermined power level, and selectively decoupling the second end of the second directional coupling element from ground responsive to a second predetermined power level.

* * * * *